US007228983B2

(12) United States Patent
Pangerc et al.

(10) Patent No.: US 7,228,983 B2
(45) Date of Patent: Jun. 12, 2007

(54) STORAGE CONTAINER

(75) Inventors: James Pangerc, Parkville, MD (US); Gregory Scott Snider, Bel Air, MD (US); Daniel G Findle, White Hall, MD (US); Jennifer R Ervin, Annapolis, MD (US); Timothy B Bailey, Forest Hill, MD (US)

(73) Assignee: Black & Decker Inc., Newark, DE (US)

( * ) Notice: Subject to any disclaimer, the term of this patent is extended or adjusted under 35 U.S.C. 154(b) by 458 days.

(21) Appl. No.: 10/694,472

(22) Filed: Oct. 27, 2003

(65) Prior Publication Data

US 2004/0099554 A1 May 27, 2004

Related U.S. Application Data

(63) Continuation of application No. 10/126,500, filed on Apr. 19, 2002, now Pat. No. 6,698,609, which is a continuation-in-part of application No. 09/840,278, filed on Apr. 23, 2001, now Pat. No. 7,048,133.

(51) Int. Cl.
*B65D 21/02* (2006.01)

(52) U.S. Cl. ..... 220/23.87

(58) Field of Classification Search ..... None
See application file for complete search history.

(56) References Cited

U.S. PATENT DOCUMENTS

| | | | | |
|---|---|---|---|---|
| 416,425 | A | 12/1889 | Schmitt | |
| 1,849,565 | A | 3/1932 | Brady | |
| 2,012,800 | A | 8/1935 | Allen | |
| 3,459,327 | A | 8/1969 | Harris | |
| 3,698,404 | A | 10/1972 | Greco | |
| D229,366 | S | 11/1973 | Yonce | |
| 3,836,043 | A | 9/1974 | Levin | |
| 4,210,252 | A | 7/1980 | Cooke et al. | |
| 4,213,532 | A | 7/1980 | Eggert et al. | |
| D264,396 | S | 5/1982 | Harvey et al. | |
| 4,615,464 | A | 10/1986 | Byrns | |
| 4,619,364 | A * | 10/1986 | Czopor, Jr. | 206/379 |
| 4,736,850 | A * | 4/1988 | Bowman et al. | 206/570 |
| 4,779,753 | A * | 10/1988 | Capy | 220/522 |
| 4,884,689 | A | 12/1989 | Su-Chin | |
| 4,930,753 | A | 6/1990 | Alvyn | |
| 4,934,549 | A | 6/1990 | Allen | |

(Continued)

FOREIGN PATENT DOCUMENTS

| | | |
|---|---|---|
| DE | 1814157 | 12/1968 |

(Continued)

*Primary Examiner*—Stephen J. Castellano
(74) *Attorney, Agent, or Firm*—Harness, Dickey & Pierce, P.L.C.

(57) ABSTRACT

A display package for a storage container includes a primary and secondary blister package. The primary blister package includes an opening incorporated thereon allowing a user to rotate a cover of the storage container through the opening about its hinge. A base of the storage container is retained within the primary blister package thereby precluding the user from withdrawing the whole storage container from the primary blister package. The secondary blister package includes a plurality of tool accessories arranged therein. The secondary blister package is disposed within an extension section of the primary blister package and positioned above the base of the storage container.

12 Claims, 17 Drawing Sheets

U.S. PATENT DOCUMENTS

| | | | | |
|---|---|---|---|---|
| 5,050,733 | A | 9/1991 | Brennan | |
| D333,727 | S | 3/1993 | Schurman | |
| D345,650 | S | 4/1994 | Boyd | |
| D347,114 | S | 5/1994 | Tengvall | |
| 5,456,357 | A * | 10/1995 | Wenner et al. | 206/372 |
| 5,553,710 | A | 9/1996 | Takama | |
| D390,358 | S | 2/1998 | Calmeise | |
| D400,011 | S | 10/1998 | Palmer et al. | |
| 5,860,549 | A * | 1/1999 | Allers et al. | 220/4.23 |
| 5,915,553 | A | 6/1999 | Brown et al. | |
| D417,077 | S | 11/1999 | Sheu | |
| D418,977 | S | 1/2000 | Streich | |
| 6,698,609 | B2 * | 3/2004 | Pangerc et al. | 220/23.87 |

FOREIGN PATENT DOCUMENTS

| | | | |
|---|---|---|---|
| DE | 2149305 | | 10/1971 |
| DE | 3150873 | A1 | 12/1981 |
| DE | G85006459 | | 1/1985 |
| DE | G8515834.8 | | 5/1985 |
| DE | G8602551.1 | | 1/1986 |
| DE | 3714789 | C2 | 5/1987 |
| DE | G8814319.8 | | 11/1988 |
| DE | G8906411.9 | | 5/1989 |
| DE | G8907073.9 | | 6/1989 |
| DE | G9312160.1 | | 8/1993 |
| DE | 29517259 | U1 | 10/1995 |
| DE | 29702619 | U1 | 2/1997 |
| EP | 0620159 | B1 | 3/1997 |
| WO | WO90/08631 | | 8/1990 |
| WO | WO94/11258 | | 5/1994 |

* cited by examiner

STORAGE CONTAINER

CROSS-REFERENCE TO RELATED APPLICATIONS

This application is a Continuation of U.S. patent application Ser. No. 10/126,500, filed Apr. 19, 2002, now U.S. Pat. No. 6,698,609, which is a Continuation-in-Part Application of U.S. patent application Ser. No. 09/840,278 filed on Apr. 23, 2001, now U.S. Pat. No. 7,048,133. The disclosures of which are incorporated herein by reference.

FIELD OF THE INVENTION

The present invention relates to a display device for tool accessory containers and related products and more particularly, to an interactive display for containers and related products.

BACKGROUND AND SUMMARY OF THE INVENTION

Accessory containers are commonly used throughout the construction industry. Various containers are generally used to organize small parts such as drill bits, nails, fasteners and the like. In some instances, such small parts may be sold as a complete set with the container. The present invention is directed toward providing an interactive display device for effectively displaying the multiple piece count tool accessories included in the set as well as displaying and communicating the features and benefits of the container. In this regard, the present invention provides a blister package having an opening incorporated on a first side of an accessory container and an enclosure portion incorporated on the opposite side of the container. As such, the enclosure portion captures the container between a front and rear surface of the blister package while the opening allows a potential customer to manipulate the first side of the container about its hinge in a direction away from the display package. The interaction allows a potential customer to feel the container to gain a better appreciation of the product and its functions as a whole.

Further areas of applicability of the present invention will become apparent from the detailed description provided hereinafter. It should be understood that the detailed description and specific examples, while indicating the preferred embodiment of the invention, are intended for purposes of illustration only and are not intended to limited the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
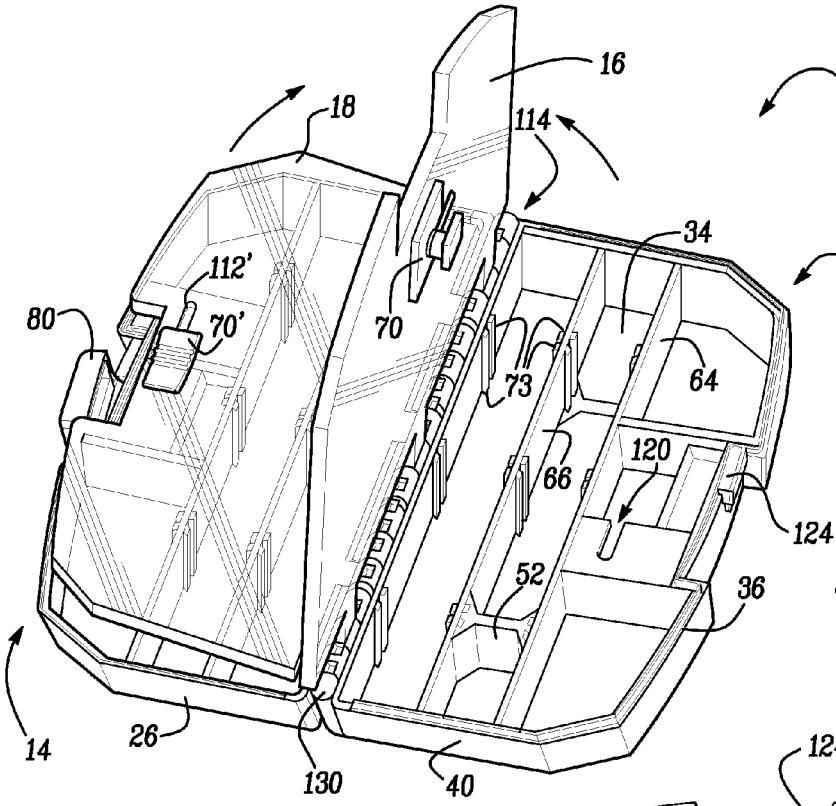
FIG. 1 is a perspective view of an assembled storage container shown in an open position.
Figure 9:
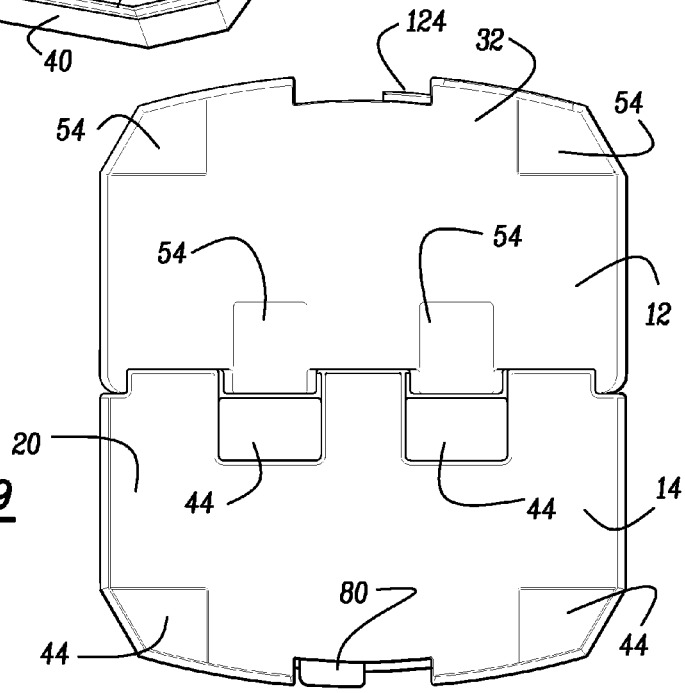
FIG. 9 is a plan view of an assembled storage container shown in an open position to illustrate the outer surface of the cover and base.

With reference to FIG. 1, the storage container 10 of the present invention is shown. The storage container 10 includes a base 12 and a cover 14 hingedly attached to the base 12. A pair of transparent lids or cover plates 16, 18 are provided for selectively enclosing the storage area defined by the base 12 and cover 14, respectively.

As shown in FIGS. 2A–2E, the cover 14 includes a cover surface 20, an inner surface 22, a top wall 24, side walls 26, 28 and a bottom wall 30. Similarly, referencing now FIGS. 3A–3E, the base 12 includes a bottom surface 32, an inner surface 34, a top wall 36, side walls 38, 40 and bottom wall 42. The storage container 10 includes removable spacers 52 (FIG. 1 and FIG. 5) that may be selectably positioned within the storage container to customize the interior space. Slidable latches 70, 70' releasably secure cover plates 16 and 18 to the base 12 and cover 14, respectively. Latch 80 releasably secures cover 14 to the base 12.

With continued reference to FIGS. 2A–2E, the cover 14 will now be described in greater detail. Cover surface 20 is contoured to include upwardly extending portions 44. The inner surface 22 includes parallel dividers 46,56 extending between side walls 26,28. Parallel dividers 46, 56 and bottom wall 30 include tabs 48 extending therefrom. Tabs 48 are configured to engage fingers 50 of removable spacers 52 (best shown in FIG. 5). Opposing tabs 48*a*, 48*b* (FIG. 2B), are laterally offset a predetermined distance such that a readily available piece of material may be substituted for a spacer 52, in the event a spacer is misplaced. The predetermined distance is configured to be a distance common to readily available scrap pieces of material such as, but not limited to, ⅛ inch plywood. Bottom surface 30 includes integrated hinge member 76. A slot 58 is configured to accept a finger 98 on latch 70' (best shown in FIGS. 1 and 6) of cover plate 18.

Turning now to FIGS. 3A–3E, the base 12 will now be described in greater detail. The inner surface 34 of the base 12 is configured much the same as the cover 14. Base surface 32 includes recessed portions 54. The recessed portions 54 are coordinated to interfit with the upwardly extending portions 44 of cover 14 such that a series of cases 10 may be securely stacked. The inner surface 34 includes parallel dividers 64, 66 extending between side walls 38,40. Parallel dividers 64, 66 and bottom wall 42 include tabs 68 extending therefrom. Tabs 68 are configured to engage tabs 50 of removable spacers 52 (best shown in FIGS. 1 and 5). Opposing tabs 68*a*, 68*b* are laterally offset a predetermined distance such that a scrap piece of material may be substituted for a spacer 52 as described above. Base 12 includes integrated hinge member 86. A slot 120 is configured to accept finger 98 on latch 70 (best shown in FIGS. 1 and 6) of cover plate 16.

The storage container 10 of the present invention allows the apertures of the hinge portion to be formed without the need of a metal rod for forming the apertures. The configuration of the cover 14 and the base 12 illustrated in FIGS. 2A–3E include hinge portions 76 and 86, respectively. The hinge member 76 of cover 14 includes tab portions 78 which are formed from a die configuration that creates cavity sections 82 (FIG. 2B) in a direction perpendicular to the plane of cover 14. Additionally, the die allows cavity sections 84 (viewed from FIG. 2E) to be formed in a direction parallel to the plane of cover 14 and in a location between cavity sections 82. The insert portions of the die are strategically located such that cavity sections 82 and 84 cooperate to form a continuous passage 88 (FIGS. 2B and 2D) which is created without the need for additional steps involving a metal rod die insert as is required with conventional hinge molding techniques.

Figure 3A:
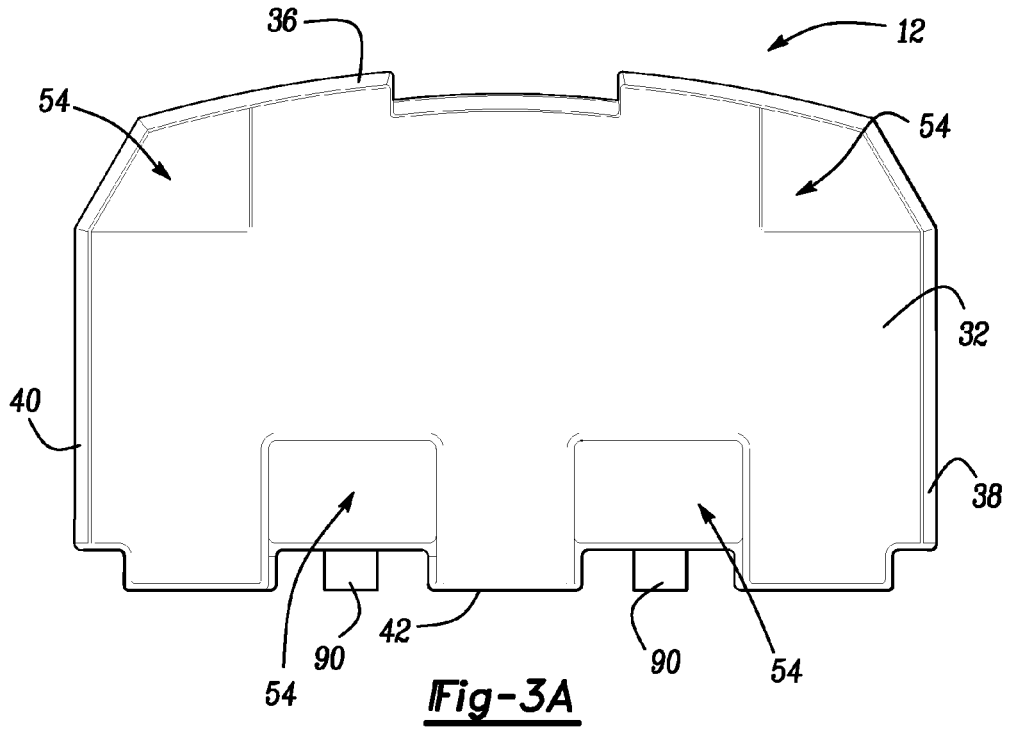
FIG. 3A is a plan view of the outer surface of the base of the storage container constructed in accordance to the teachings of the preferred embodiment.
Figure 3B:
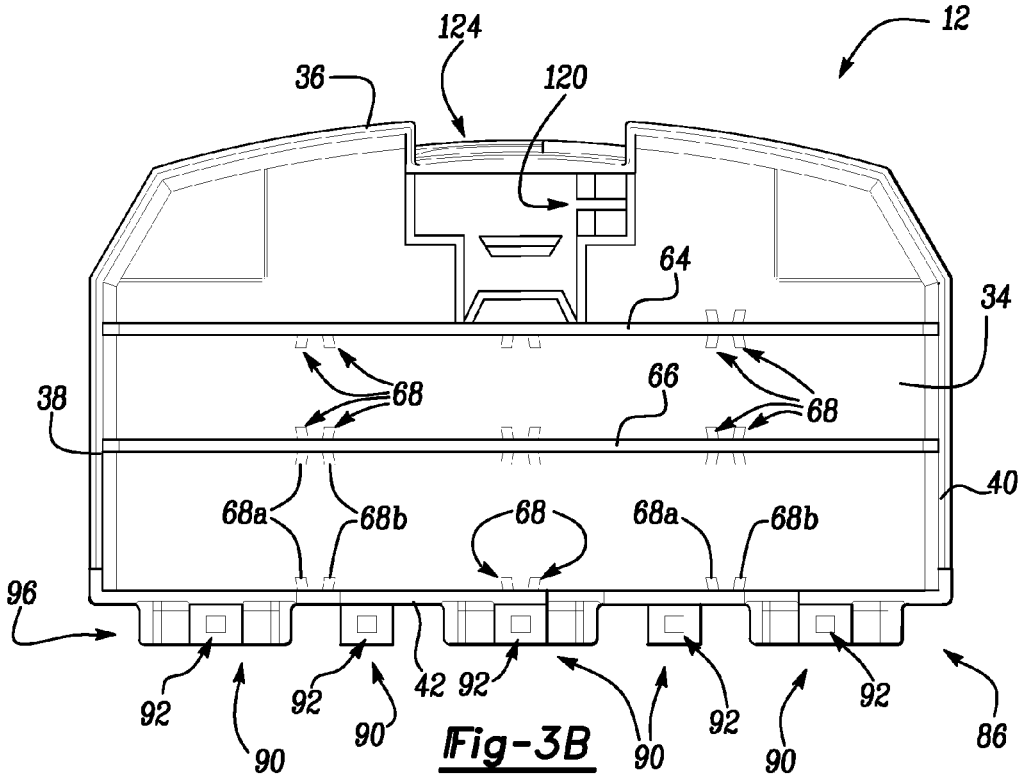
FIG. 3B is a plan view of the inner surface of the base.
Figure 3C:
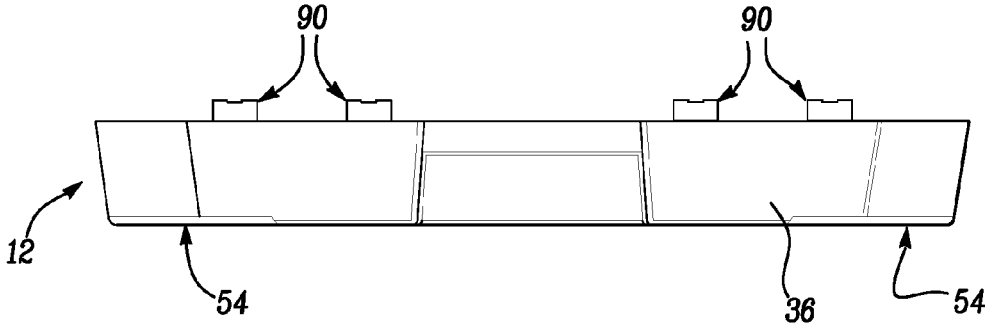
FIG. 3C is a top view of the base.
Figure 3D:
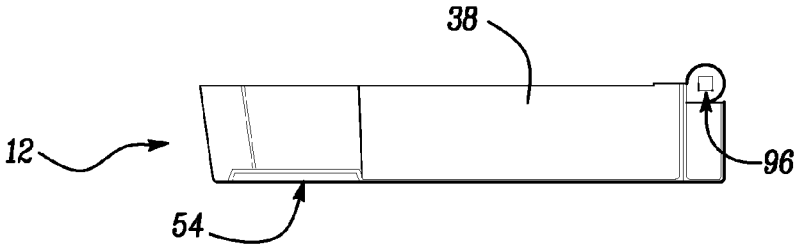
FIG. 3D is a side view of the base.
Figure 3E:
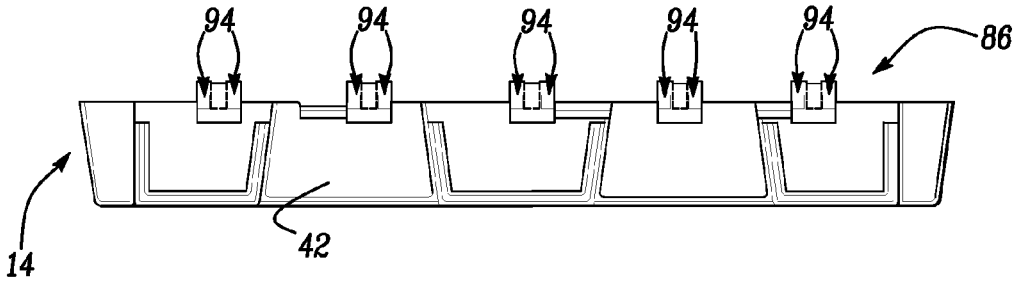
FIG. 3E is a bottom view of the base.

The base 12 is molded in a similar fashion to create a continuous passage for a hinge pin. Tab portions 90 of hinge member 86 include cavity sections 92 (FIG. 3B) perpendicular from the plane of base 12. Accordingly, cavities 94 (FIG. 3E) are also incorporated in a direction parallel to the plane of base 12. Cavities 92 and 94 cooperate to form a continuous passage 96 (FIG. 3B and FIG. 3D).

Figure 4A:
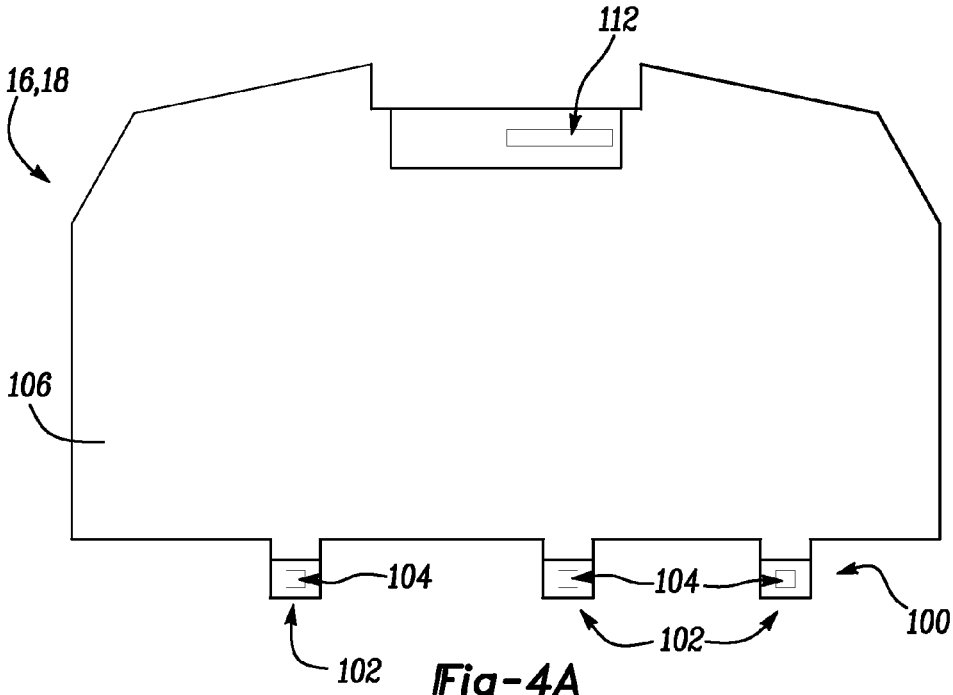
FIG. 4A is a plan view of the first side of a cover plate according to the principles of the present invention.
Figure 4B:
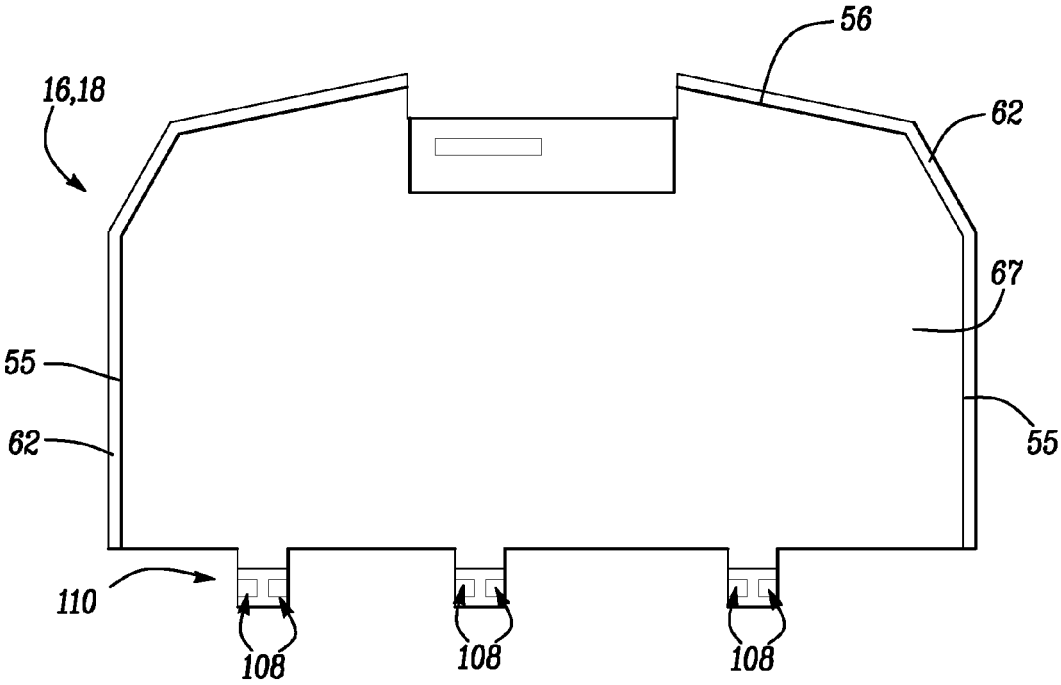
FIG. 4B is a plan view of the second side of the cover plate.
Figure 4C:
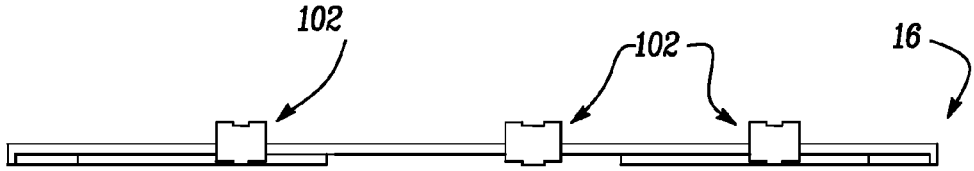
FIG. 4C is a rear view of the cover plate.
Figure 4D:
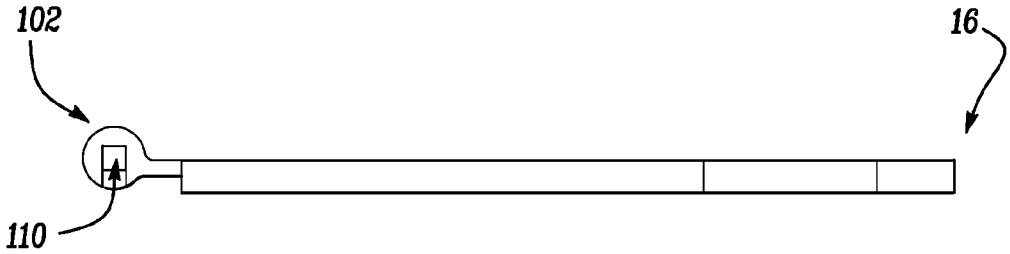
FIG. 4D is a side view of the cover plate.
Figure 6:
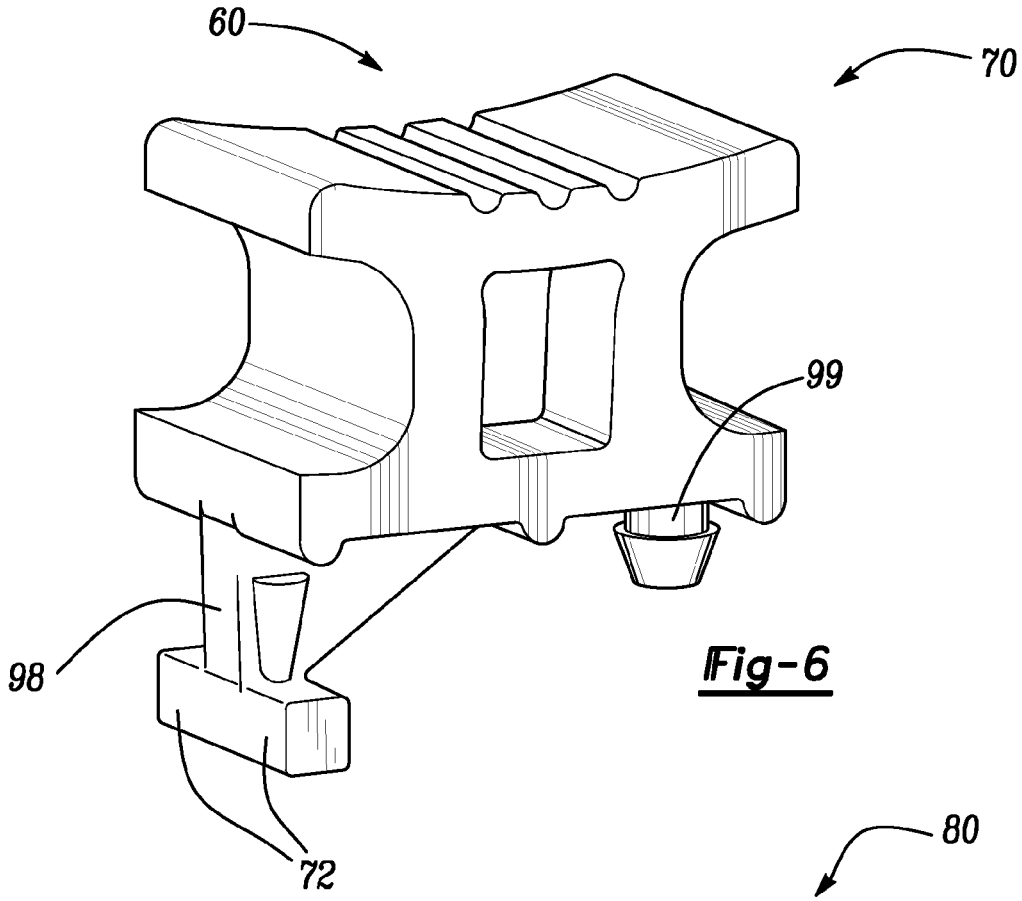
FIG. 6 is a perspective view of a cover plate latch according to the principles of the present invention.

Turning now to FIGS. 4A through 4D, the interior of case 10 includes two symmetric transparent cover plates 16,18. The cover plates 16,18 are molded with the same hinge strategy as mentioned for the cover 14 and base 12. The tab portions 102 of hinge sections 100 include cavities 104 formed perpendicular to face 106 of cover plate 16,18 on a first side of the cover plates 16,18. Cavities 108 are also formed from the geometry of the die and are perpendicular to face 106 on a second side of the cover plates 16, 18. Cavities 104 and 108 are parallel to each other and offset which cooperate to form a continuous passage 110 (FIG. 4D). The tab portions 102 of the cover plates are laterally offset such that a first cover plate 16 may be turned 180 degrees from a second cover plate 18 allowing the tab portions 102 to interfit. This feature allows both cover plates 16,18 to be molded from the same die. Cover plates 16,18 include a slot 112 integrated thereon to accept slidable latches 70,70' (FIGS. 1 and 6).

Cover plates 16, 18 further include a raised lip or edge 62. Raised edge 62 is preferably formed around the side walls 55 and at least a portion of the top wall 56 of the cover plates. Raised edge 62 provides increased structural strength and rigidity to cover plates 16, 18. In this manner, raised edge 62 resists twisting and fatigue associated with repeated manipulation of the cover plates. In a preferred orientation, the raised edge 62 extends toward inner surface 22 and 34 of the cover and base respectively.

Figure 8A:
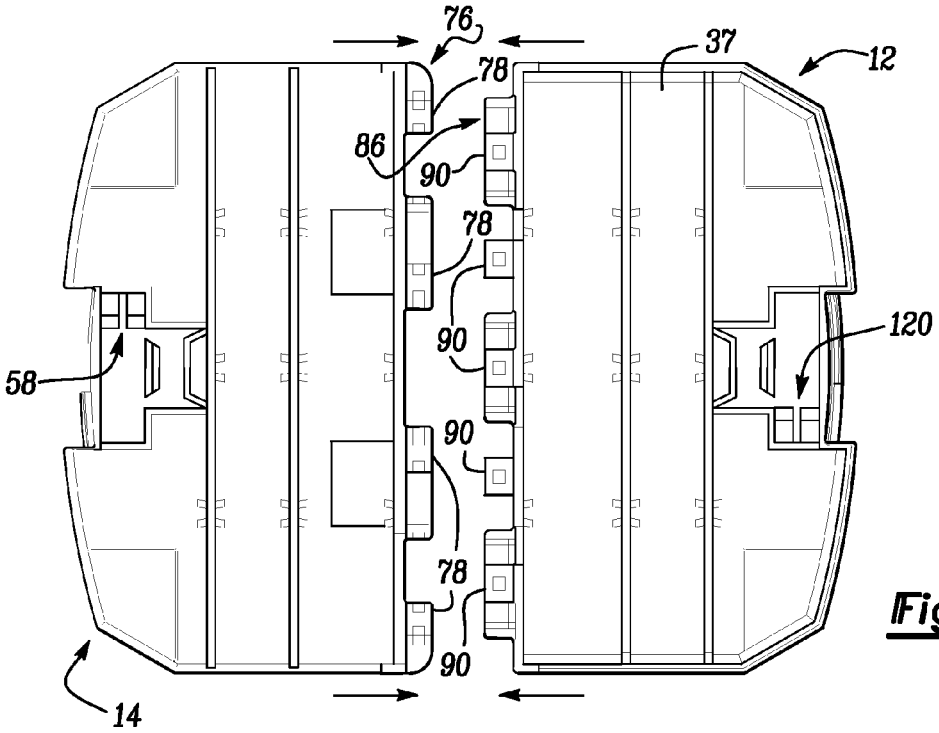
FIG. 8A is a plan view of the inner surfaces of the cover and base to illustrate the alignment of the tab portions.
Figure 8B:
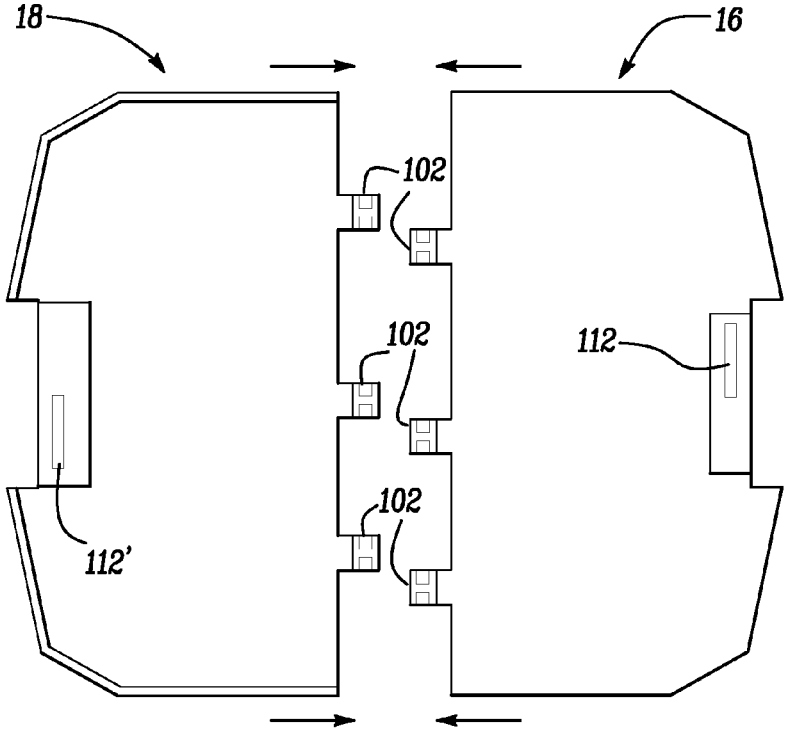
FIG. 8B is a plan view of the first and second cover plates, the second cover plate is identical to the first but rotated and flipped 180 degrees from the first cover plate.

Referring now to FIGS. 8A and 8B, tab portions 90 of hinge 86 of the base 12 are offset from hinge portions 78 of cover 14 so as to interfit when mated. Furthermore, the tab portions 102 of the cover plates 16,18 are positioned between hinge members 86,76 of the base 12 and cover 14, respectively (placing FIG. 8B onto FIG. 8A to create FIG. 1). The respective hinge portions 90 of base 12, 78 of cover 14 and 102 of cover plates 16,18 interfit to define one continuous passage 114 aligned to accept a hinge pin 130 (FIG. 1).

Hinge pin 130 is preferably made of a rigid material such as metal. Hinge pin 130 is zinc coated to provide increased lubricity during installation. The zinc coating further inhibits premature rusting or corrosion of the hinge.

Figure 5:
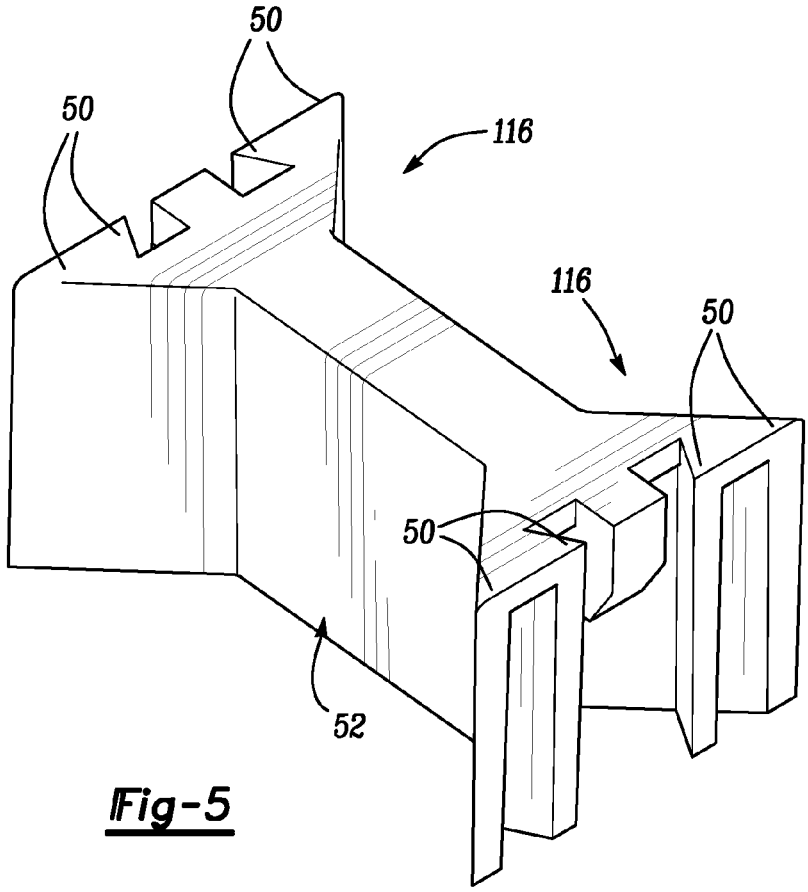
FIG. 5 is a perspective view of a spacer according to the principles of the present invention.

Turning now to FIG. 5, the spacer 52 will now be described. A series of spacers 52 will be included for the user to customize the size of the inner compartments. Spacer 52 includes flared arms 116 having fingers 50 extending therefrom. The fingers 50 are adapted to slidably engage tabs 48 of cover 14 or tabs 68 of base 12. The spacers are made from a flexible material such as soft rubber or other elastomeric material. The flared arms 116 of spacers 52 are contoured such that an object may be easily removed from the box without becoming caught in a 90 degree corner of an inner compartment. The internal configuration also provides shock resistance in the event of a drop or sudden impact.

Referencing now FIGS. 4A, 4B and 6 with continued reference to FIG. 1, the cover plates 16 will now be described. Cover plate 16 includes a latch 70 slidably engaged with slot 112. The latch 70 (best shown in FIG. 6), includes body 74, having an arm 98 and outwardly extending fingers 72 and tang 99. Wing section 60 has a contoured surface to enhance grip while sliding latch 70. Latch 70 is slidably engaged to slot 112 of cover plate 16. When a cover plate 16 is in its closed position, latch 70 may be laterally moved such that fingers 72 of arm 98 engage the rear surface of slot 120 securing the cover plate 16 to base 12 in a locked position.

The second cover plate 18 (identical to the first cover plate but flipped 180 degrees) also includes a slot 112' and latch 70'. The latch 70' slidably engages slot 58 of cover 14 when in a locked position. The relationship of latches 70, 70' to cover plates 16 and 18 are such that the latches 70,70' of the cover plates 16,18 must be in a locked position in order for the carrying case 5 to properly close. Explained further, if the latches 70, 70' are not in a locked position, the wing 60 of latches 70, 70' will abut against one another preventing the case 10 from properly closing.

Figure 2A:
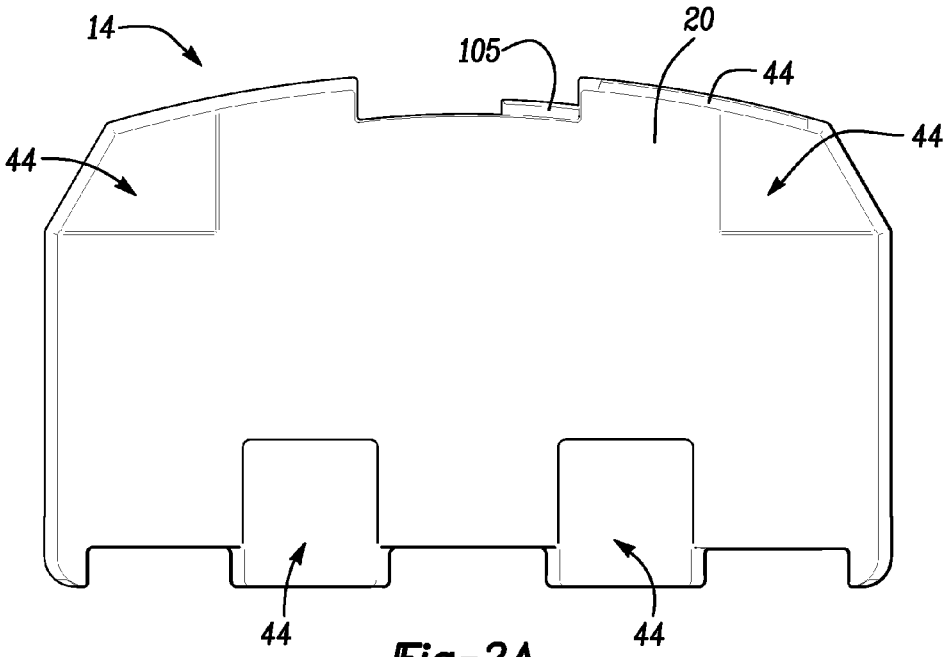
FIG. 2A is a plan view of the outer surface of the cover constructed in accordance to the teachings of the preferred embodiment.
Figure 2B:
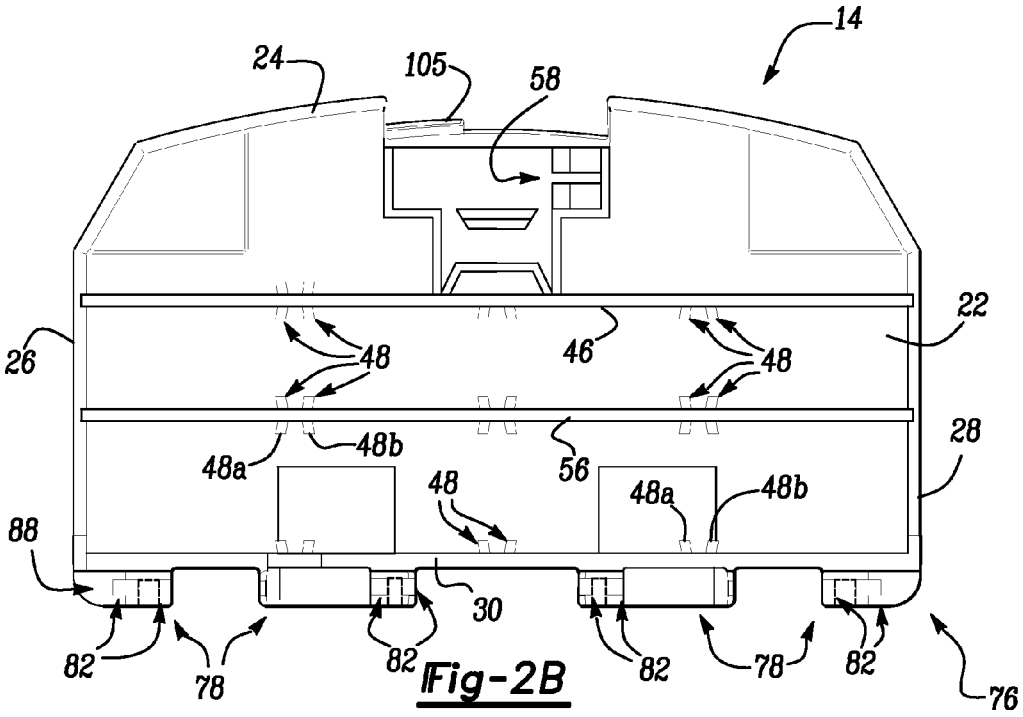
FIG. 2B is a plan view of the inner surface of the cover.
Figure 2C:
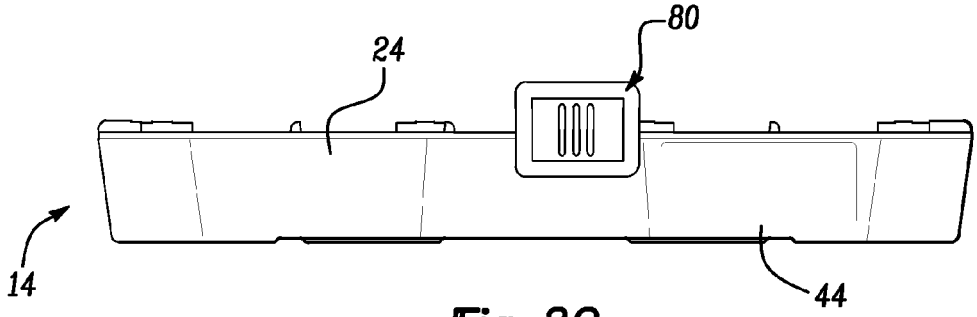
FIG. 2C is a top view of the cover.
Figure 2D:
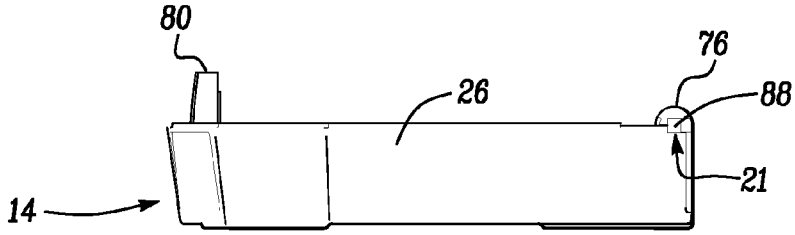
FIG. 2D is a side view of the cover.
Figure 2E:
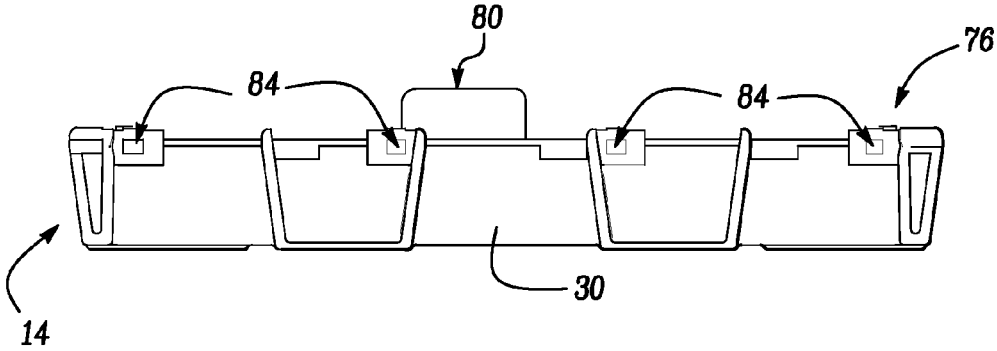
FIG. 2E is a bottom view of the cover.
Figure 7:
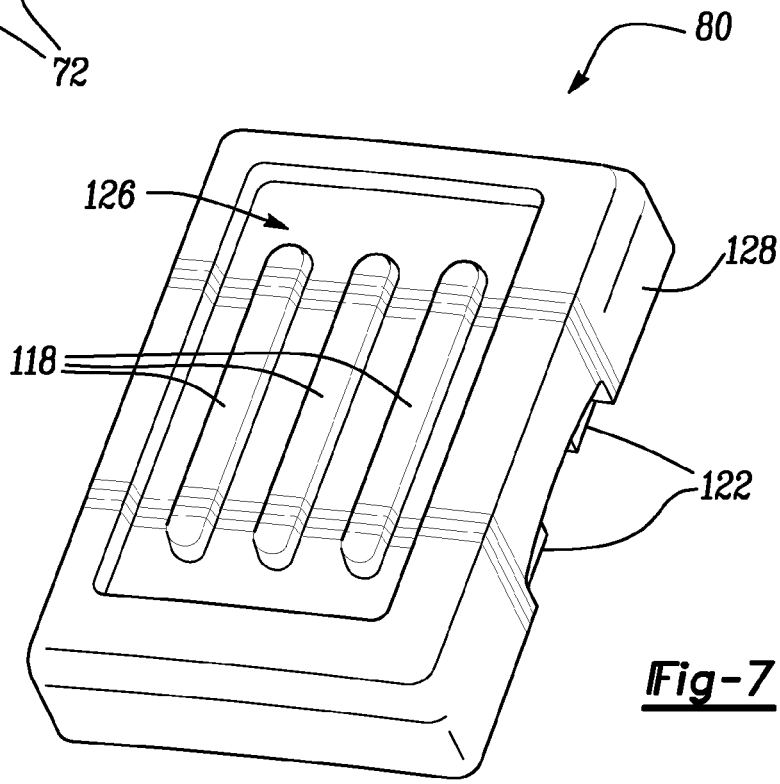
FIG. 7 is a perspective view of the storage case latch member according to the principles of the present invention.

Turning now to FIG. 7 with continued reference to FIGS. 2A and 2B, the cover 14 includes a slidable latch 80. The slidable latch 80 includes outer circumferential wall 128 including fingers 122 for engagement with track 124 of base 12 and track 105 on cover 14. Ribs 118 laterally extend from face 126 of latch 80 to improve grip.

Figure 10A:
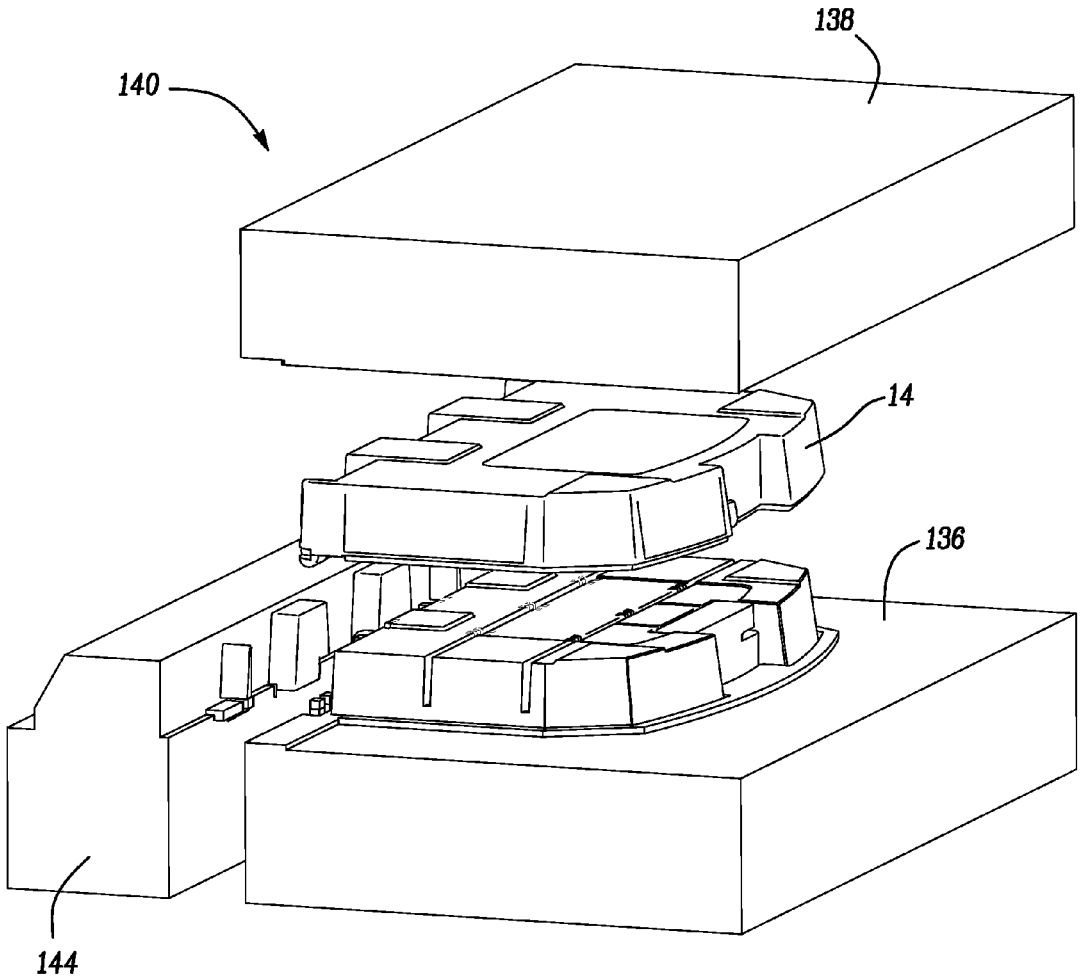
FIG. 10A is an exploded perspective view of a mold used to construct a cover portion of the storage container according to the preferred method of the present invention.
Figure 10B:
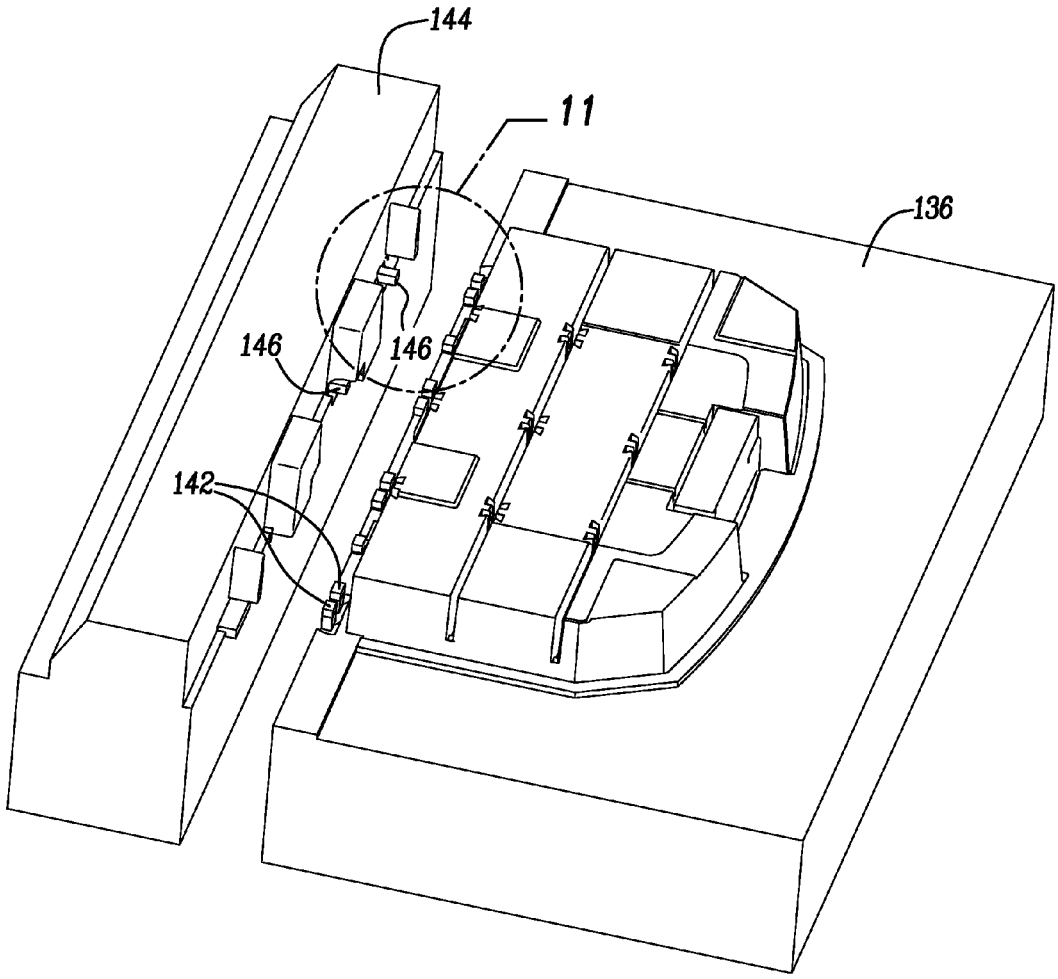
FIG. 10B is an exploded perspective view of the bottom and side mold members used to construct the cover portion according to the preferred method of the present invention.
Figure 11:
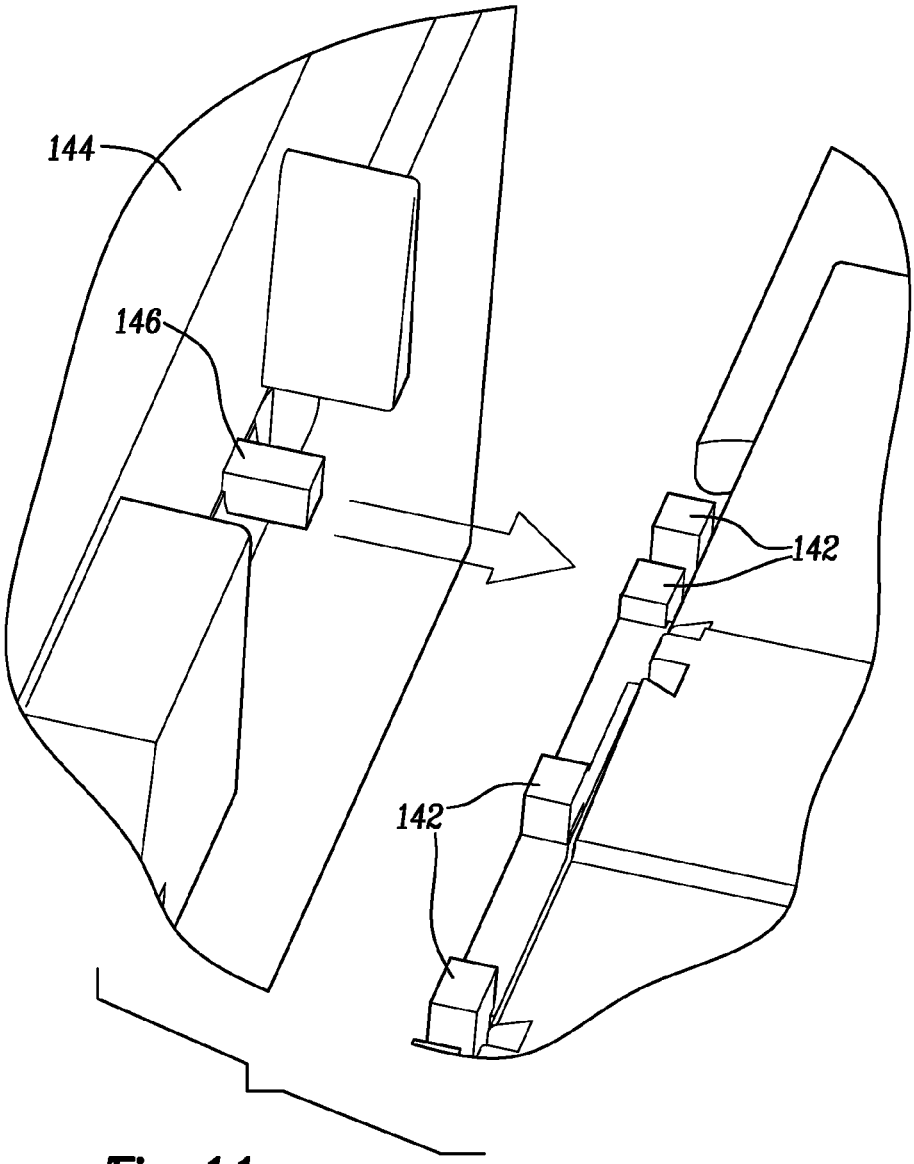
FIG. 11 is an enlarged perspective view of the area 11 of FIG. 10 illustrating the alignment of the hinge forming pegs.

Referencing FIGS. 10 and 11, the mold used to construct the cover 14 of the storage container 10 will now be described. The tool 140 includes a first, second, and third die member 136, 144, and 138. Die 136 includes vertical pegs 142 extending therefrom. The base 12 is molded from a similar tool having a corresponding peg and tab arrangement which are offset from those of the cover tool 140 such that the molded parts cooperate to form a hinge. As such, a similar die arrangement is used to mold the cover plates 16, 18.

The preferred method of constructing the cover 14 of storage container 10, will now be described. A first die member 136 is provided having a series of pegs extending in a first direction. A second die member 144 is provided having a series of pegs extending in a second direction, the second direction being perpendicular to the first direction. The first and second die members are closeably arranged into a mold position in tool 140, the pegs of the second die member 144 being arranged to extend between a pair of adjacent pegs of the first die member 136 in the mold position. Working material is admitted to tool 140. The working material is cured and the tool 140 is opened. A cover portion of the container is removed from tool 140. The cover portion includes a first continuous aperture formed along a series of cover tab members defining a first hinge portion, the first aperture extending in a third direction, the third direction being perpendicular to the first and second directions.

The preferred method of constructing the base 12 of storage container 10 will now be described. A third die member is provided having a series of pegs extending in the first direction. A fourth die member is provided having a series of pegs extending in the second direction. The third and fourth die members are closeably arranged into a mold position in tool 140, the pegs of the fourth die member being arranged to extend between a pair of adjacent pegs of the third die member in the mold position. Working material is admitted to tool 140. The working material is cured and the tool 140 is opened. The base portion 12 is removed and includes a second continuous aperture formed along a series of base tab members defining a second hinge portion, the second aperture extending in the third direction.

The preferred method of constructing lid 16 will now be described. As previously explained, construction of lid 18 is performed by the same method. A fifth die member having a series of pegs extending in the first direction is provided. A sixth die member is provided having a series of pegs extending in the second direction. The fifth and sixth die members are closeably arranged into a mold position in tool 140, the pegs of the sixth die member being arranged to extend between a pair of adjacent pegs of the fifth die member in the mold position. Working material is admitted to tool 140. The working material is cured and the tool 140 is opened. Lid 16 is removed from the tool 140, the first lid including a third continuous aperture formed along a series of first lid tab members defining a third hinge portion, the third aperture extending in the third direction.

Assembly of container 10 will now be described. The first aperture of the cover is aligned with the second aperture of the base revealing a continuous through-hole. The third aperture of the first lid 16 is aligned with the continuous through-hole thereby placing the first lid between the base 12 and cover 14. A second lid 18 is rotated lengthwise 180 degrees from lid 16. The fourth aperture of the second lid is aligned with the continuous through-hole thereby placing the second lid 18 adjacent the first lid 16 and between the base 12 and cover 14. Pin 130 is inserted through the continuous through-hole thereby hingedly connecting base 12, lids 16, 18 and cover 14.

Figure 12:
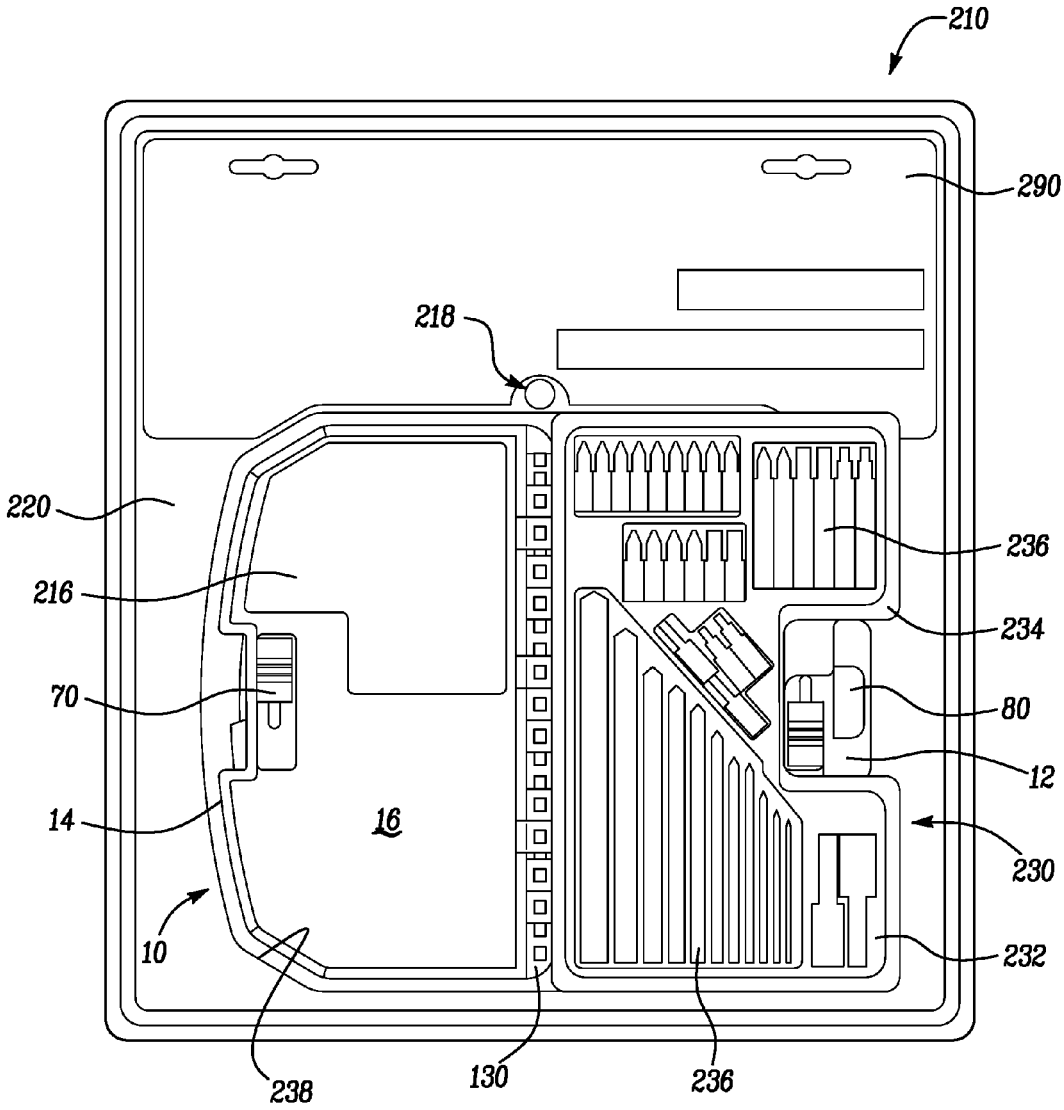
FIG. 12 is a plan view of the interactive multi-piece accessory set display package.
Figure 13:
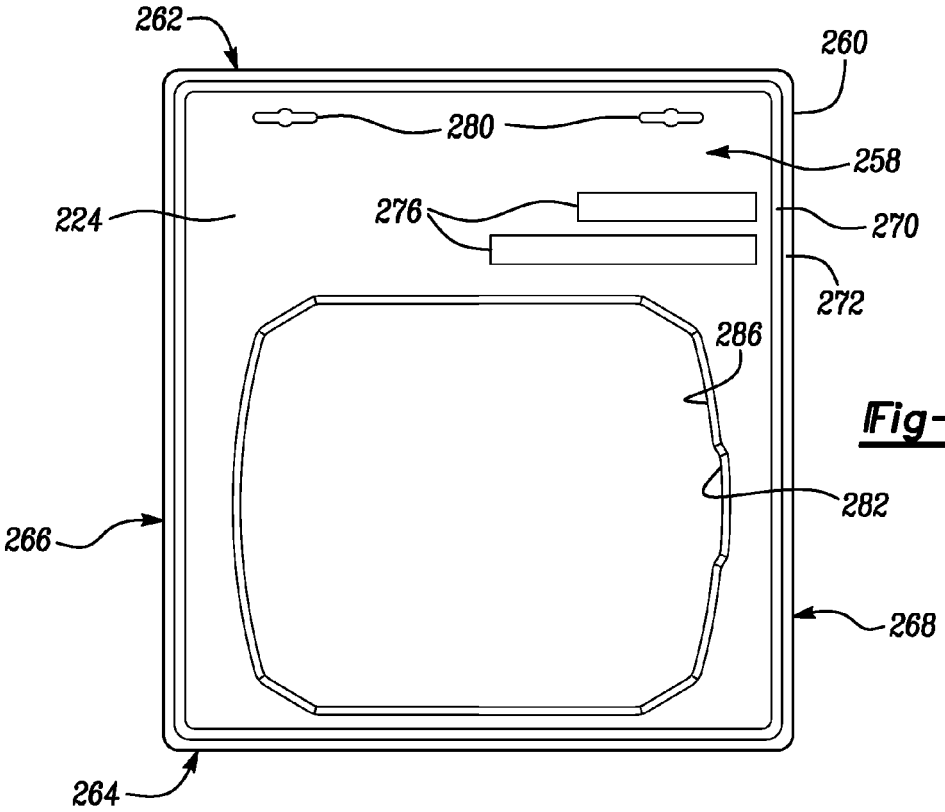
FIG. 13 is a plan view of the rear primary blister surface of the display package.
Figure 14:
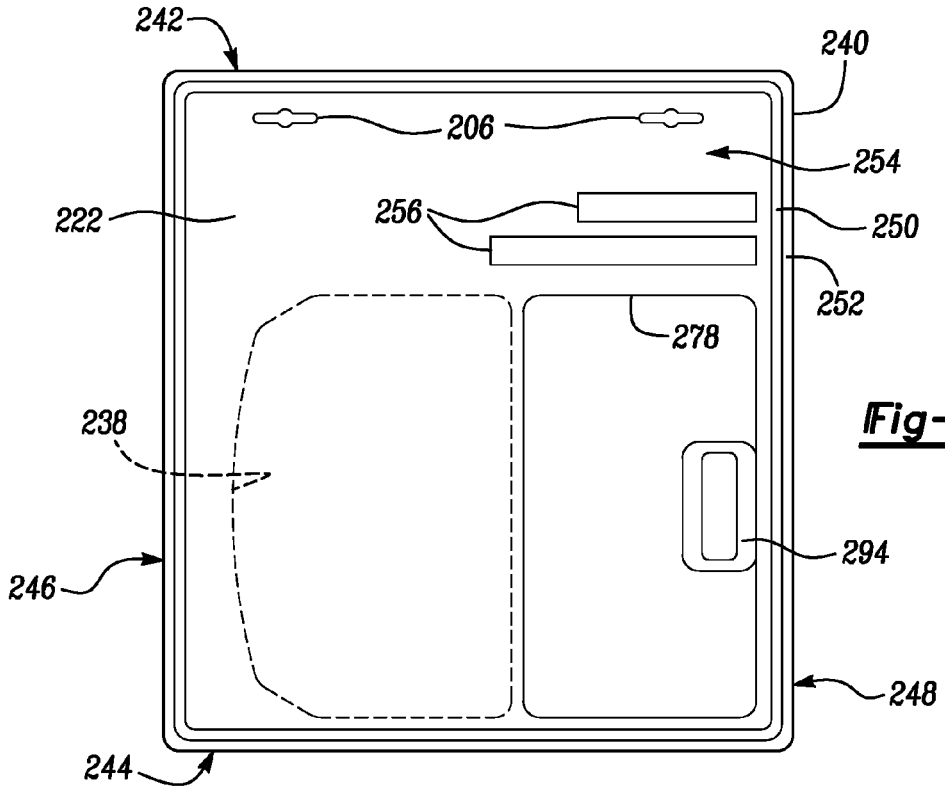
FIG. 14 is a plan view of the front primary blister surface of the display package.

With reference to FIGS. 12–14 the display package 210 for displaying the storage container 10 will now be described in greater detail. Primary blister package 220 includes a 2-piece or clam shell plastic thermoformed blister hereinafter referred to as front and rear primary blister surfaces 222, 224, shown in FIGS. 14 and 13, respectively. Primary blister package 220 is configured to surround a secondary blister package 230 above the base 12 of the storage container 10. Secondary blister package 230 is also a 2-piece or clam shell plastic thermoformed blister hereinafter referred to as front and rear secondary blister surfaces 232, 234 respectively. Secondary blister package 230 contains a plurality of tool accessories 236 such as drill bits, screwdriver bits and the like.

With continued reference to FIGS. 12–14, primary package 220 surrounds base 12 however it is appreciated that primary package 220 may alternatively surround cover 14. The cover surface (not specifically shown) of container 10 is bounded by rear blister surface 224. An opening 238 is provided in the front blister surface 222 to provide access to cover plate 16. As such, a potential purchaser or user may actuate latch 70 to gain access to the interior storage of cover 14. In this regard, the interior features of the cover 14 may be manipulated including spacer 20. Furthermore, the cover 14 may be rotated toward a direction through opening 238 about hinge 130. Accordingly, the user may interact with the container features to gain an understanding of the workability and useability of the container 10.

With particular reference to FIG. 14, the front primary blister 222 will now be described in greater detail. Front primary blister 222 includes perimeter 240 having upper and lower edges 242, 244 and first and second side edges 246, 248. Perimeter 240 is further defined by ribbed channel 250 and outer flange 252 extending therearound. As will be described in further detail, ribbed channel 250 provides a sealing surface for mating front and rear primary blisters 222, 224 together. An upper portion 254 includes blister portions 256 incorporated to accept additional tool accessories 212 such as tool bit drive guides not included with secondary package 230. It will be appreciated that blister portions 256 may resemble alternate shapes to accommodate alternate desired accessories. Opening 238 is incorporated on front primary blister 222 to allow for user interaction with container 10. Extension section 278 incorporates a depth sufficient to accept secondary blister package 230. In addition, extension dome 294 provides the depth sufficient to accommodates latch 80. Cutout sections 206 are incorporated in upper portion 254. Cutout sections 206 are configured to allow hanging posts (not shown) to extend therethough on a display shelf.

Turning now to FIG. 13, rear primary blister 224 will be described in further detail. Rear primary blister 224 includes perimeter 260 having upper and lower edges 262, 264 and first and second side edges 266, 268. Perimeter 260 is further defined by ribbed channel 270 and outer flange 272 extending therearound. Ribbed channel 270 has a depth and width sufficient to cooperatively interfit within ribbed channel 250 of front primary blister 222. Depressions 276 are arranged to compliment blister portions 256 of front primary blister 222.

It is appreciated that additional tool accessories may alternatively be arranged to fit entirely within blisters 256 removing the need for depressions 276. Likewise, it may be desirable to arrange additional tool accessories entirely in depressions 276 allowing the complementary portion of front primary blister 222 to remain flush.

Cavity 286 is arranged on rear primary blister 224 to accommodate the footprint of entire container 10. As such, projection 282 is incorporated to accommodate latch 80. Blister portions 276 are incorporated in upper portion 258. Cutout sections 280 are complementary with cutout sections 206 of front primary blister 222 and likewise align to allow hanging posts (not shown) to extend therethrough on a display shelf.

Figure 17:
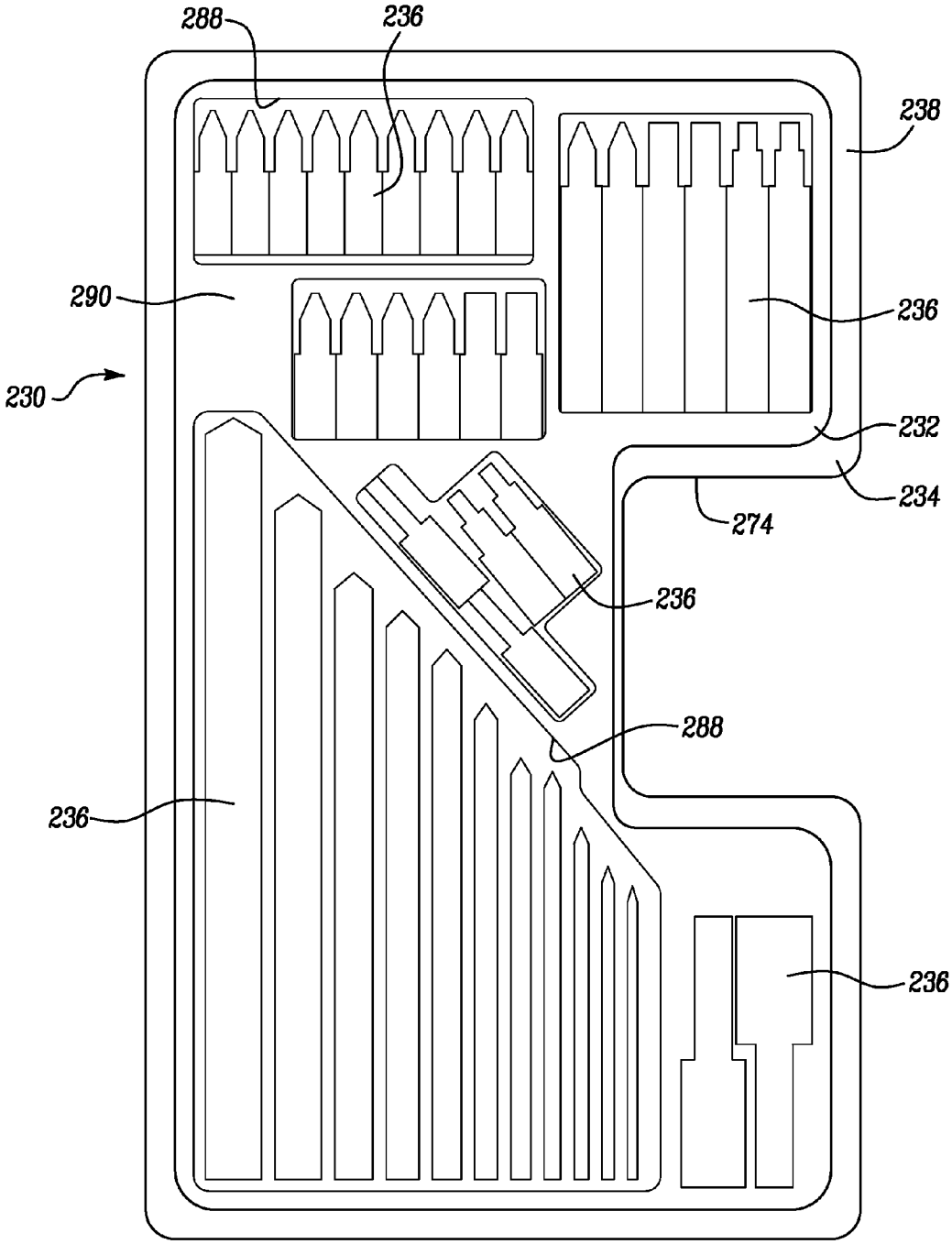
FIG. 17 is a plan view of the secondary blister package.

Turning now to FIG. 17, secondary blister package 230 includes cavities 288 arranged therein. Cavities 288 are preferably formed on rear secondary blister surface 234. Cavities 288 are prearranged in an optimized layout in secondary blister package 230 to accommodate the desired tool bits 236. Front and rear secondary blister surfaces 232, 234 are thermoformed together at predetermined locations thereon such as around perimeter 239. Alternatively, front and rear blister surfaces 232, 234 may include complementary depressions (not shown) arranged on the interior. In this regard, front and rear blister surfaces 232, 234 may be thermoformed together along the complementary depressions.

Figure 15:
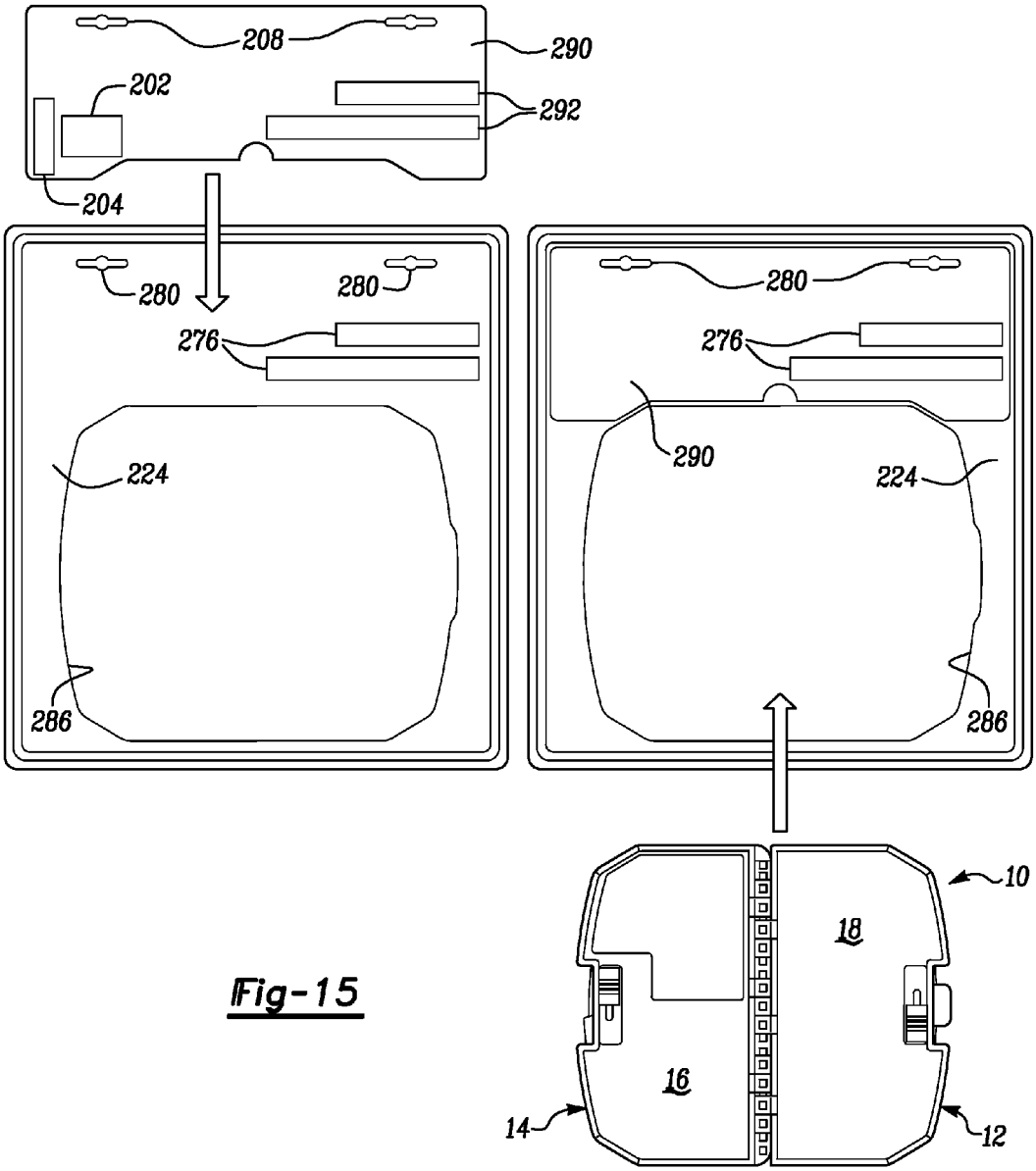
FIG. 15 is an exploded view of the display package illustrating a preferred placement of the storage container and insert card.
Figure 16:
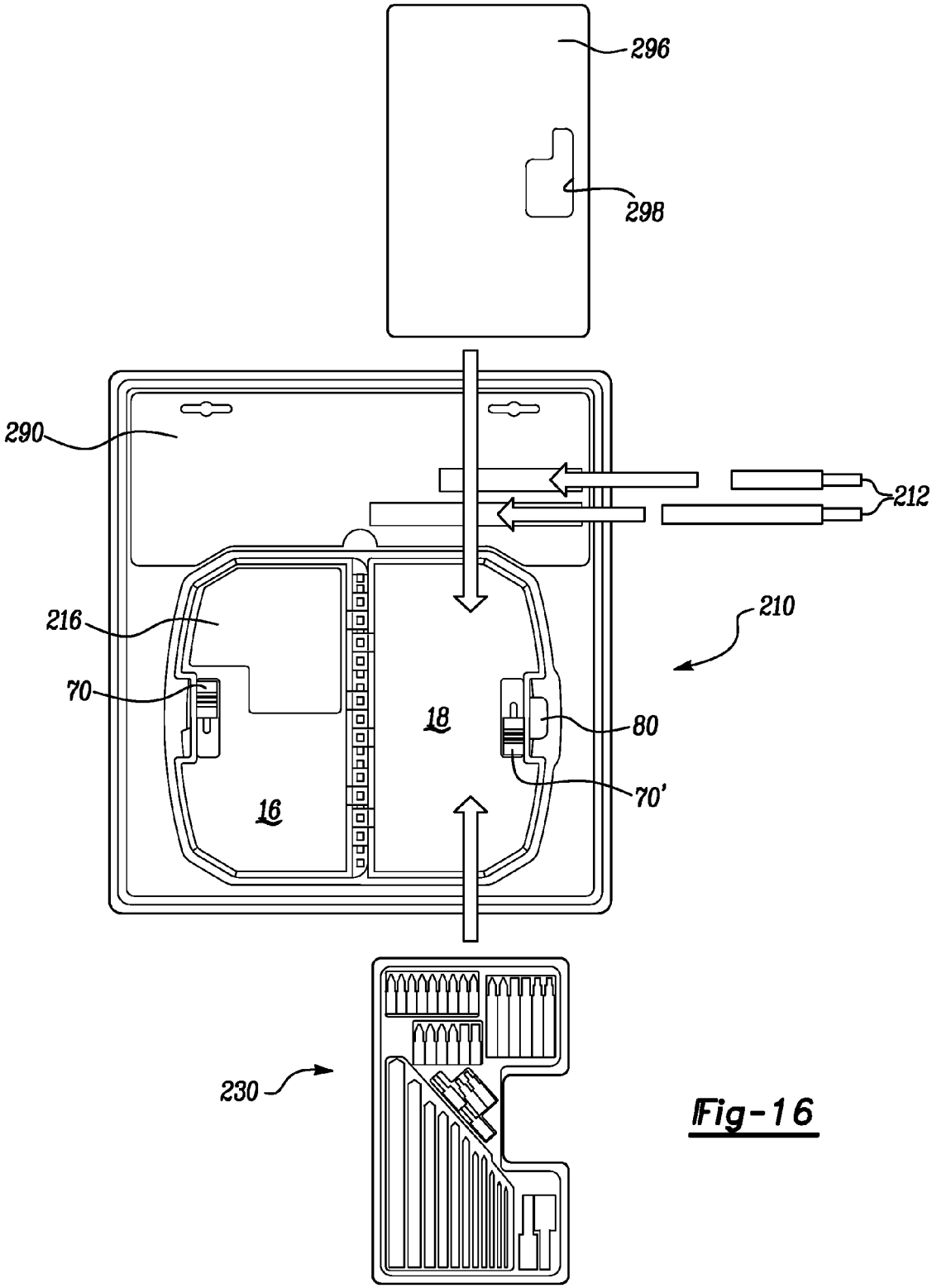
FIG. 16 is an exploded view of the display package illustrating a preferred placement of the secondary blister package, secondary tool accessories and the divider card.

Referring now to FIGS. 15 and 16, insert card 290 is disposed between front and rear primary blister 222, 224 in an assembled condition. Insert card 290 is preferably positioned on upper portion 254 and incorporates cutouts 292 to cooperatively align with blister portions 256 and 276. In addition, insert card 290 includes cutouts 208 which align with cutouts 206 and 280 of front and rear primary blister surfaces 222 and 224 respectively. Insert card 290 includes product information such as a company name and contents of package 210. Insert card 290 includes UPC 202 and sensor tag 204. Sensor 204 is incorporated to cooperate with a stores security system to reduce theft. A divider card 296 is disposed between secondary blister package 230 and base 12 of container 10. Label 216 including further description of container 10 is adhesively attached to cover plate 16. Divider card 296 includes cutout 298 to accommodate latch 70' and latch 80. Insert card 290 and divider card 296 are constructed of rigid material such as cardboard. A label 216 further describing the features of the container 10 is adhesively disposed on cover plate 16, as shown in FIG. 12.

The preferred assembly of display package 210 having container 10 retained therein will now be described. Again, while the following description is directed to placing base portion 12 on a common side as the secondary blister package 230, it is appreciated that secondary blister package 230 may be incorporated on a common side as the cover 14 of container 10. In this regard, extension dome 294 would not be required in a configuration having secondary blister package 230 on a common side as cover 14.

Initially, as illustrated in FIG. 15, insert card 290 is positioned onto upper portion 258 of rear primary blister 224. Container 10 is then deposited into cavity 286 orienting cover 14 on the left and base 12 on the right as viewed from FIG. 13. Next, additional tool bits 212 are deposited into the depressions formed by the blister portions 276. Divider card 296 (FIG. 16) is placed onto cover plate 18 orienting cutout 298 in a location to receive latch 70 and latch 80 therethrough.

Secondary blister package 230 is preferably assembled by placing tool bits 236 in respective cavities 288. After front and rear secondary blister surfaces 232, 234 are thermoformed together in the above discussed manner, the secondary blister package 230 is placed above divider card 296 allowing indent 274 (FIG. 17) to locate around latch 70 and latch 80, as shown in FIG. 12.

Top primary blister surface 222 is finally positioned over rear primary blister surface 224 thereby capturing secondary blister package 230 therebetween. Front and rear primary blister surface 222, 224 are preferably thermoformed together around ribbed channels 250, 270. In addition, front and rear primary blister surfaces 222, 224 are thermoformed together at a spot seal 218 in a location adjacent hinge 130. The spot seal 218 is incorporated to provide additional mating support while discouraging access to secondary tool bits 212, insert card 290 and secondary blister package 230.

The invention being thus described, it will be obvious that the same may be varied in many ways. For example, although the storage container and display package of the present invention are disclosed for use with a series of tool bit accessories, it should be understood that the storage container and display package can be used with other accessories such as, but not limited to, fishing tackle, pills, fasteners, sewing accessories, and other types of accessories that include multiple small pieces for which a storage container such as the one disclosed herein can be utilized. Such variations are not to be regarded as a departure from the spirit and scope of the invention, and all such modifications as would be obvious to one skilled in the art are intended to be included within the scope of the following claims.

What is claimed is:

1. A display package comprising:

a front blister surface having an opening arranged therein;

a rear blister surface coupled to said front blister surface and having a cavity configured therein, said front and rear blister surfaces including complementary channels configured to interfit in an assembled condition and extending around respective perimeters thereof; and a storage container having a front and rear side received in said cavity, said opening of said front blister surface arranged around one of the first and second sides of said storage container thereby allowing the one of the first and second sides of the storage container to rotate outwardly about a hinge through said opening.

2. The display package of claim 1 wherein said front and rear blister surfaces of said display package are thermoformed together.

3. The display package of claim 2 wherein said front and rear blister surfaces of said display package are thermoformed together around said complementary channels.

4. The display package of claim 1 wherein an insert card is disposed between said front and rear blister surfaces of said display package, said insert card including product information thereon.

5. A display package comprising;

a primary package having an opening formed in a front blister surface and a cavity formed on a second blister surface, said first and second blister surfaces including complementary channels configured to interfit in an assembled condition and extending around respective perimeters thereof; and a storage container having a first and second side received in said cavity, said first and second side rotatably coupled such that one of said first and second sides is rotatable outwardly from said cavity through said opening in said front blister surface.

6. The display package of claim 5, further comprising a secondary package positioned in an extension portion formed in said front blister surface of said primary package.

7. The display package of claim 5 wherein said first and second blister surfaces are thermoformed together around said complementary channels.

8. The display package of claim 5 wherein said first and second side of said storage container are rotatable about a hinge configured on said storage container.

9. A combination storage container and display package, comprising:

the storage container including a first container portion hingedly coupled to a second container portion, said first container portion and said second container portion being pivotable between a closed position with said first and second container portions being overlapped for defining a closed cavity therebetween, and an open position with said first and second container portions being in a side-by-side un-overlapped position;

the display package including a front surface and a rear surface, one of said front and rear surfaces defining a cavity configured to accept the storage container therein with the storage container in an open position with the first and second container portions in the side-by-side un-overlapped position, said front surface including an opening in said front surface arranged around one of the first and second container portions of the storage container thereby allowing the one of the first and second container portions of the storage container to rotate outwardly about a hinge through said opening, and wherein said front and rear surfaces of said display package include complementary channels configured to interfit in an assembled condition and extending around respective perimeters thereof.

10. The combination of claim 9, wherein said front and rear surfaces of said display package are thermoformed together.

11. The combination of claim 9, wherein said front and rear surfaces of said display package are thermoformed together around said complementary channels.

12. The combination of claim 9, wherein an insert card is disposed between said front and rear surfaces of said display package, said insert card including product information thereon.

* * * * *